US006843171B1

(12) United States Patent
Altman et al.

(10) Patent No.: US 6,843,171 B1
(45) Date of Patent: Jan. 18, 2005

(54) PRODUCT FEED MECHANISM FOR HYDRAULIC PRESS

(75) Inventors: Paul C. Altman, Naperville, IL (US); Brian A. Altman, Aurora, IL (US); Paul W. Altman, Naperville, IL (US)

(73) Assignee: Altman Manufacturing Company, Lisle, IL (US)

( * ) Notice: Subject to any disclaimer, the term of this patent is extended or adjusted under 35 U.S.C. 154(b) by 0 days.

(21) Appl. No.: 10/166,404

(22) Filed: Jun. 11, 2002

(51) Int. Cl.[7] ..... B30B 15/30

(52) U.S. Cl. ..... 100/207; 100/141; 100/179; 100/216; 100/188 R; 72/420; 198/621.2

(58) Field of Search ..... 100/207, 214, 100/141, 179, 216, 188 R, 177; 72/419, 420, 446, 448, 405.05, 405.06, 405.07, 405.08, 405.09, 405.12, 405.16, 405.01; 198/621.1, 621.2, 621.3, 621.4

(56) References Cited

U.S. PATENT DOCUMENTS 1,021,501 A * 3/1912 Bettendorf ..... 414/754
4,651,866 A 3/1987 Imanishi et al.
4,785,657 A * 11/1988 Votava ..... 72/405.14
5,078,570 A 1/1992 Loock
5,225,725 A 7/1993 Shirake et al.
5,269,168 A * 12/1993 Ogawa ..... 72/405.1
5,566,814 A * 10/1996 Hofele ..... 198/621.1
5,749,290 A 5/1998 Johnson et al.
5,808,382 A 9/1998 Ira et al.
6,105,414 A * 8/2000 Yamada et al. ..... 72/405.16
6,312,206 B1 * 11/2001 Pylate et al. ..... 414/345

FOREIGN PATENT DOCUMENTS

JP 1157733 * 6/1989

* cited by examiner

*Primary Examiner*—Allen Ostrager
*Assistant Examiner*—Shelley Self
(74) *Attorney, Agent, or Firm*—Patnaude & Videbeck

(57) ABSTRACT

A hydraulic press utilizes a product feed mechanism including a product lifting linkage capable of raising and lowering a product-holding platen while maintaining same in a precise horizontal position during such movement. The hydraulic drive for the lifting and lowering mechanism is capable of moving the platen to any precise vertical position and maintaining same at that position before, during and after press operations. In connection with the lifting and lowering mechanism, a linear motor horizontal drive mechanism is coordinated with the lifting mechanism to enable the product feed system to precisely position the platen anywhere along the travel of the linear motor. The combination of the lifting and lowering mechanism with the linear motor horizontal drive mechanism provides, when operated by an open architecture PC control system, a new and improved product feed mechanism more precisely controllable than heretofore known.

4 Claims, 9 Drawing Sheets

PRODUCT FEED MECHANISM FOR HYDRAULIC PRESS

This invention relates to a computer operated hydraulic press utilized as a finishing machine for manufacturing operations on various plastic and/or rubber material parts, and more particularly, to a lifting and feeding mechanism for moving those plastic parts into and out of the finishing operations while maintaining those parts in a predetermined (horizontal) orientation while precisely vertically moving those plastic sheets into and out of the finishing operation.

BACKGROUND OF THE INVENTION

Presses have for years been utilized to provide cutting, bending, forming and other basic manufacturing operations on parts of small sizes and large sizes sufficient to be inserted between the crown and press bed. While innovations to hydraulic presses have been legion throughout the years because of the versatility of presses in manufacturing operations, persons and entities involved in manufacturing operations in addition to developing numerous dies for use in the process, have developed numerous apparatus for moving material to be operated on in the press into and out of the position at which the press operations take place. Additionally, applicant has been involved in inventing protective rocker-arm safety devices for presses as shown in U.S. Pat. No. 4,161,140.

When the product parts are substantially smaller than the opening between the press dies, it is typical to have these parts formed in row-column order on a sheet of material that is passed through the press. The press then stamps, cuts, forms or performs other operations on multiple ones of those parts as each individual part is a discrete segment of that sheet of material. Typically, a sheet of such material that is to be formed into parts is positioned on a movable platen by manual or robotic means, or by transfer of the part from one platen to another in a line or series of presses performing differing operations on the parts to be manufactured. Various press transfer apparatuses have typically included linkages having bell cranks to turn rotary motion into linear motion as shown in U.S. Pat. No. 4,651,866. Screw mechanisms have heretofore been utilized to move platens horizontally into and out of position in presses as shown in U.S. Pat. No. 5,749,290. Parallel linkages have also been utilized to feed material to and through presses and/or equipment for machining operations, as shown in U.S. Pat. No. 5,078,570.

In a prior generation of applicant's presses, sheets of plastic and/or rubber material were positioned on a platen which was moved into position into and over the lower die mounted on the press. In order to conserve energy and motion, the platen was hinged at its far end to a screw drive type feed mechanism and, at the near end of the sheet, the platen was raised and lowered as necessary to put the desired portion of the sheet into the correct spatial zone between the upper and lower dies. This mechanical pivoting of the platen and screw drive horizontal location of the platen provided satisfactory results for then current technology finishing operations in the press. Linear motors have been utilized in machine tool operations and in other manufacturing operations as shown in U.S. Pat. Nos. 5,225,725 and 5,808,382.

A need has developed for more accurate positioning of products with respect to the dies in a commercial press. Additionally, a need has arisen to more accurately move a sheet product into a position between the dies of a press to allow manufacturing operations to be undertaken to the sheet of material in a more accurate manner than heretofore known.

It is therefore and object of the present invention, generally stated, to provide new and improved apparatus for moving product into and out of a position in a press where operations may be performed on that product.

It is a further object of the present invention to provide more accurate means of moving a sheet product vertically with respect to a press than heretofore known.

It is a further object of the present invention to provide improved means for moving a sheet product longitudinally with respect to a press than heretofore known.

SUMMARY OF THE INVENTION

The invention resides in a transfer device for moving material through a press with actuation of the press on that material. The transfer device includes a tray having leading and trailing portions for retaining the material thereon and further includes guide means for aiding in the movement of the tray perpendicularly to the orientation of the press. The invention resides in an improvement comprising means for maintaining the tray in a predetermined orientation with the press while moving the tray vertically with respect to the press and horizontally along the guide means with greater precision than heretofore known.

BRIEF DESCRIPTION OF THE DRAWINGS

The features of the present invention which are believed to be novel are set forth with particularly in the appended claims. The invention may best be understood by reference to the following description taken in conjunction with the accompanying drawings in which like numerals refer to like parts and in which:

DETAILED DESCRIPTION OF THE PREFERRED EMBODIMENT

Figure 1:
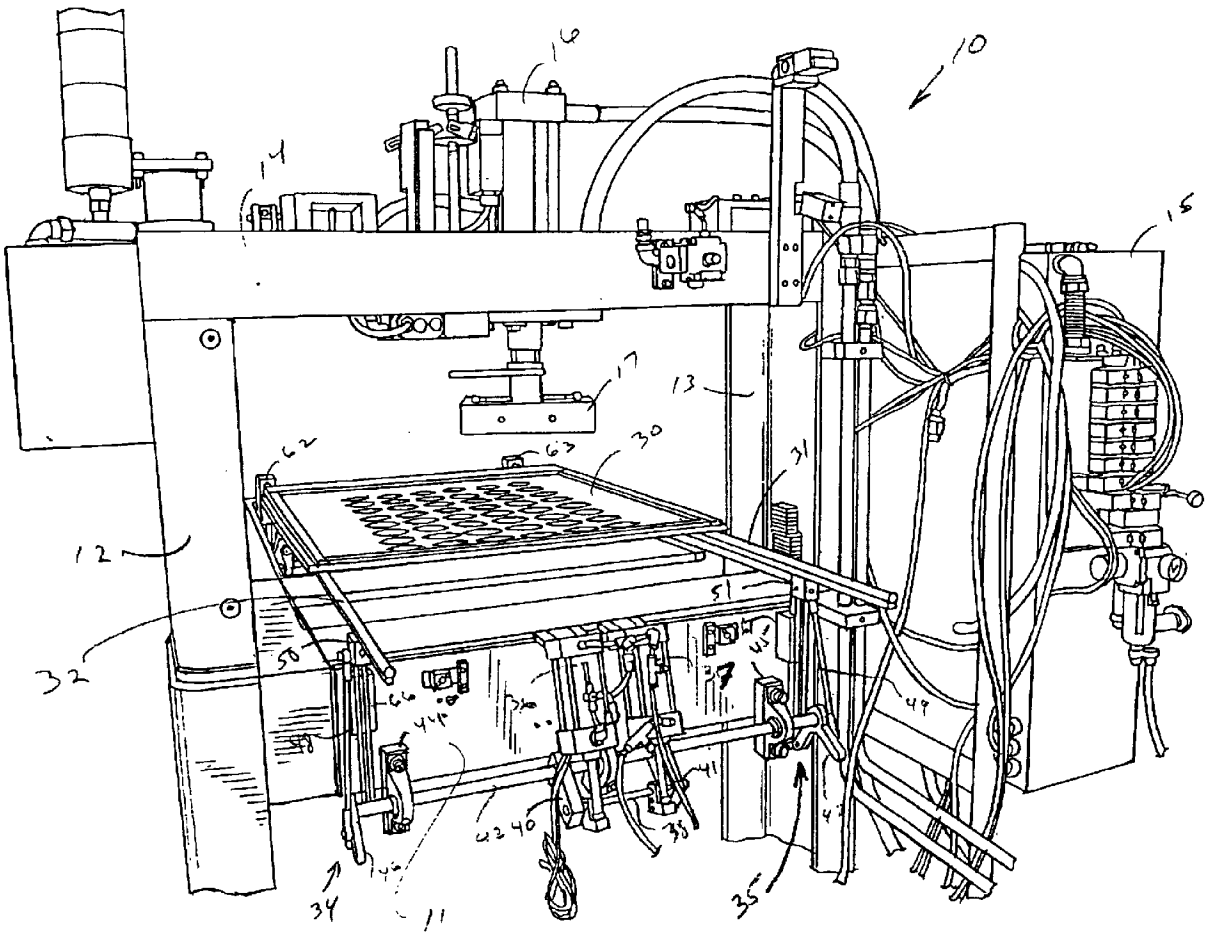
FIG. 1 is a ¾ front fragmentary perspective view of the press constructed in accordance with the present invention, carrying platen and product feed mechanism utilized to move same into and out of position for operations thereon.
Figure 2:
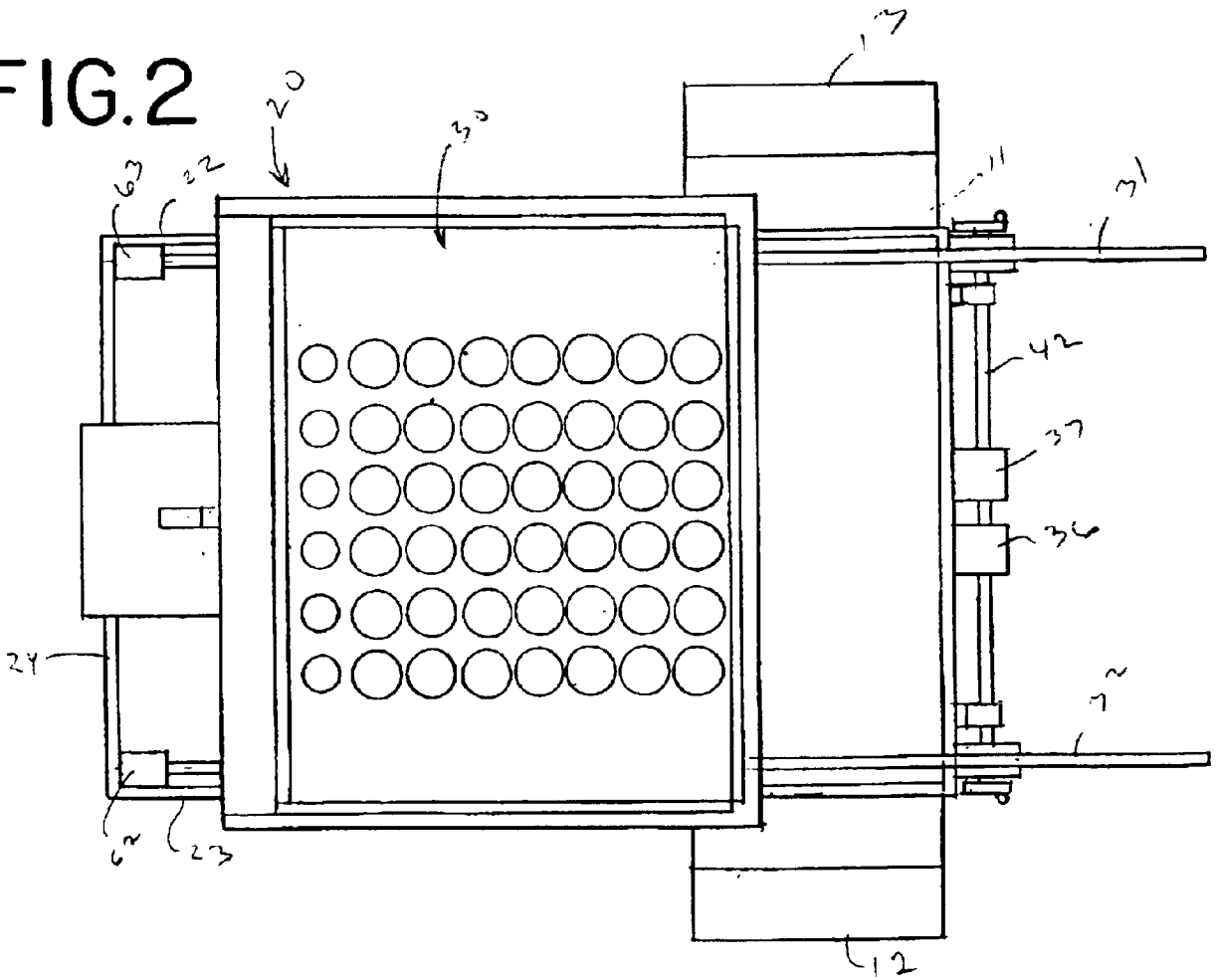
FIG. 2 is a top plan detail view of the press with the crown removed, showing the platen and product movement apparatus shown in FIG. 1.

Referring to FIG. 1, a hydraulically operated press, generally indicated at 10, includes a press bed 11, a pair of opposing uprights 12, 13, and a crown 14 extending between the uprights 12 and 13 at the top of the press 10. A first control box 15 mounted on the outside of upright 13 includes hydraulic control means for operating various parts of the press.

A press drive hydraulic cylinder 16 is mounted on the crown 14 and it includes a press slide or ram 17 at the bottom thereof on which upper dies (not shown) are mounted. Below the cylinder 16 and press slide 17 adjacent the press bed 11, will be positioned a bolster plate (not shown) in which lower dies (not shown) are mounted.

Referring to FIGS. 1, 2, 3*a* and 3*b*, while some hydraulically operated presses feed material through the press parallel to the length of the crown, the press 10 of the present invention includes a product feed mechanism 20 that is perpendicular or transverse to the long dimension of the crown 14.

Figure 3A:
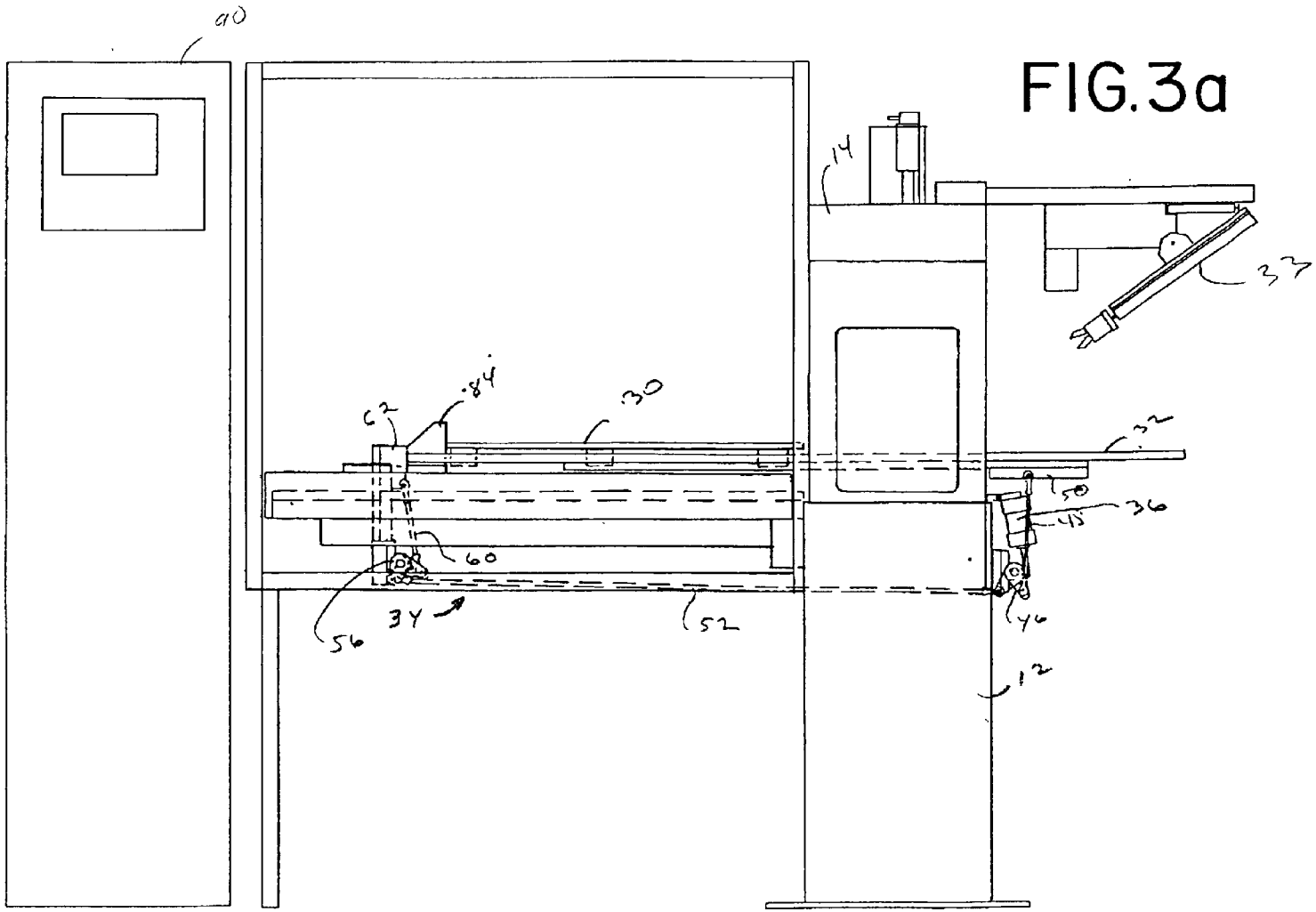
FIG. 3*a* is a side elevational diagrammatic view of the press showing the platen and movement linkage of the invention in its lowered position.
Figure 3B:
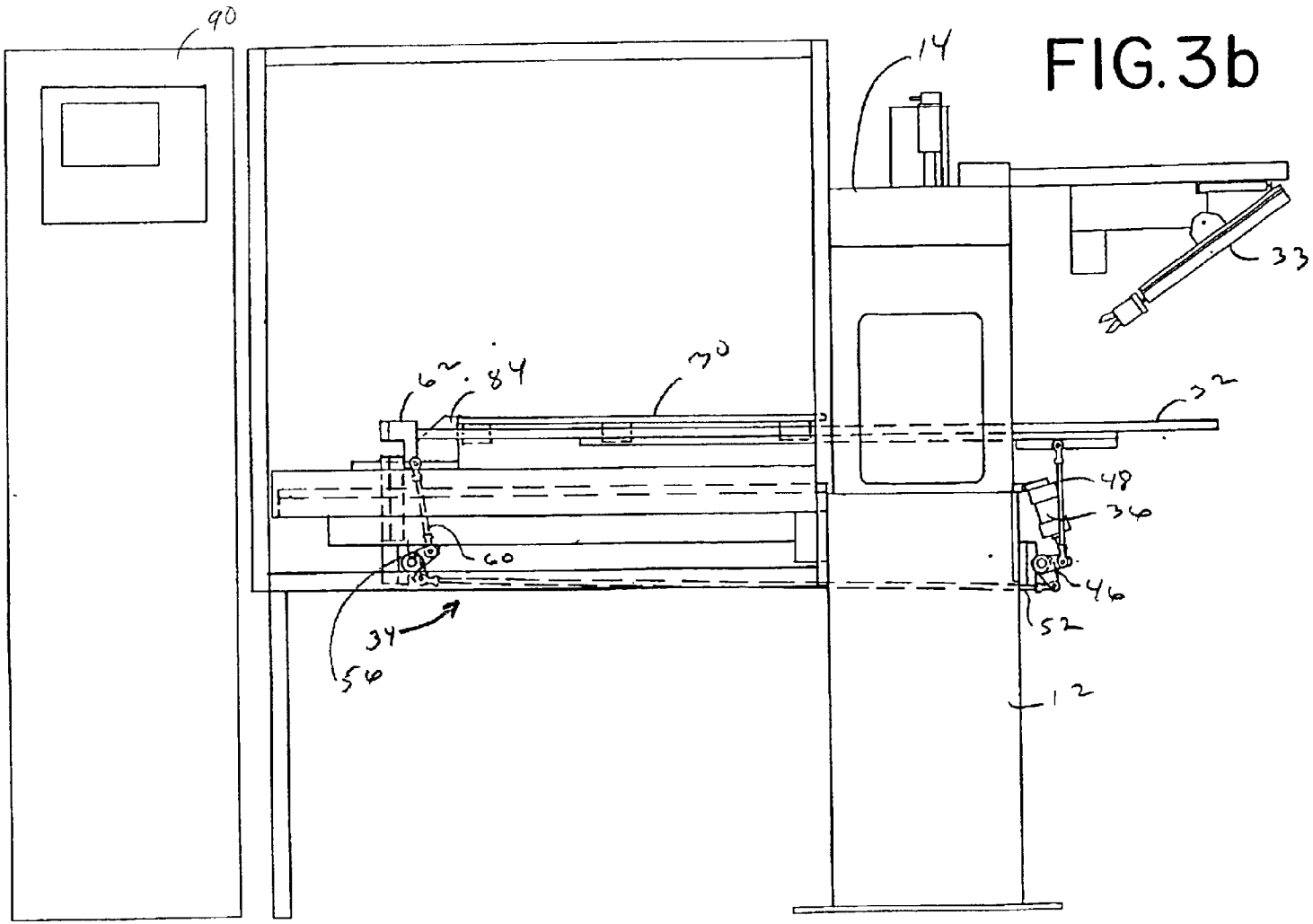
FIG. 3*b* is a side elevational diagrammatic view similar to FIG. 3*a* showing the platen and movement linkage of the invention in an uplifted, extended position.
Figure 6:
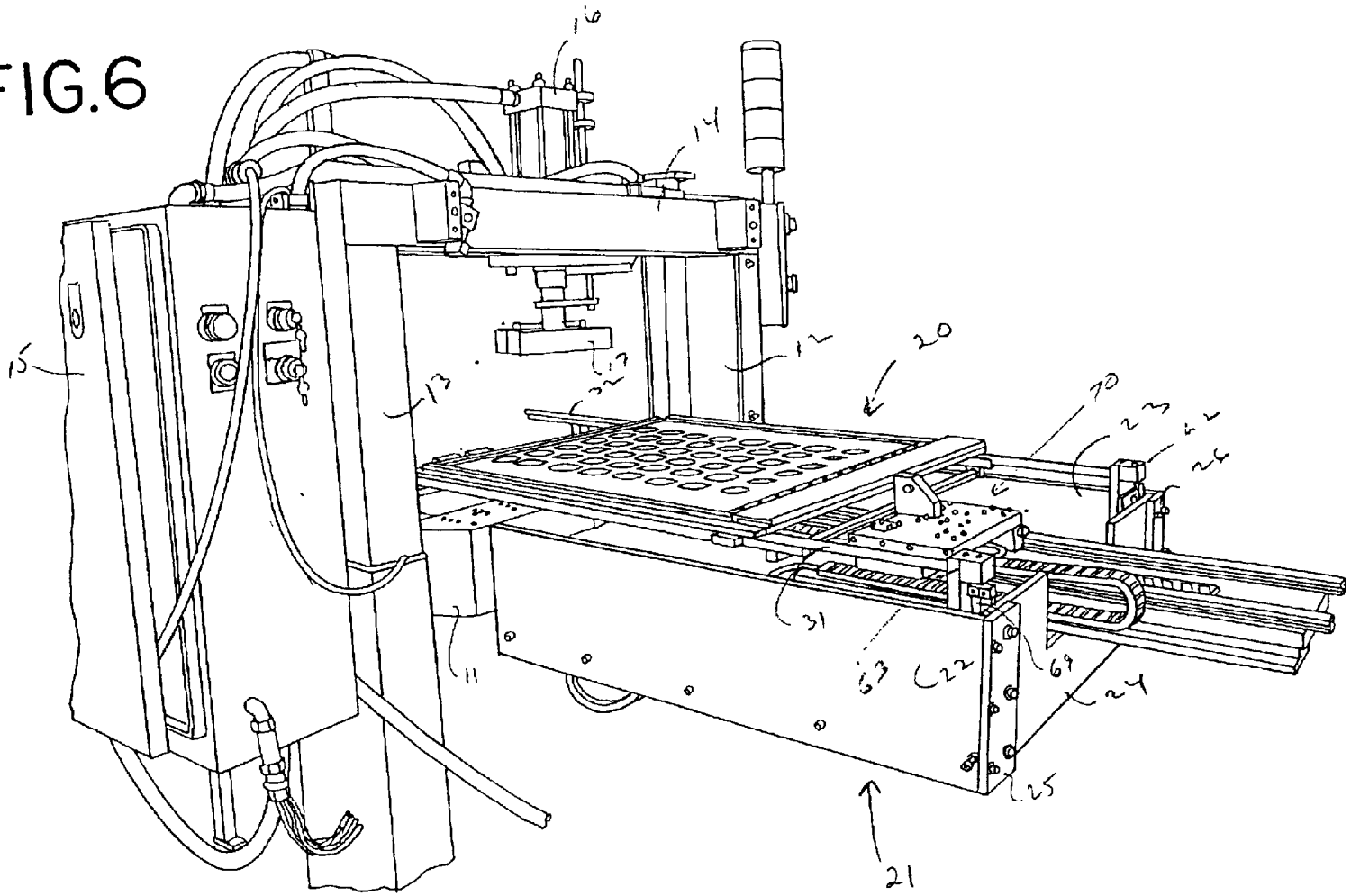
FIG. 6 is a rear quarter perspective view of the sheet moving platen and linear motor horizontal drive.
Figure 7:
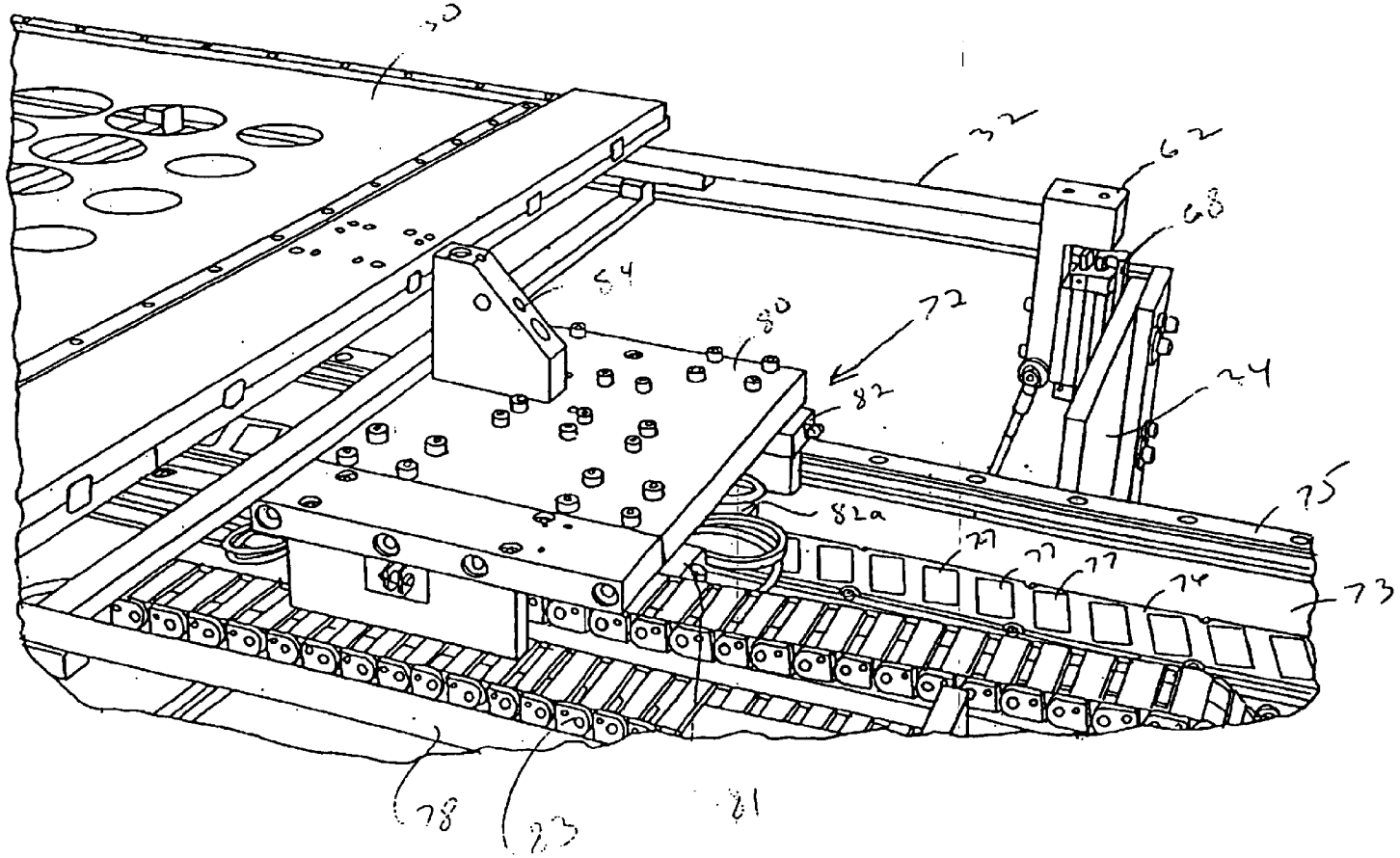
FIG. 7 is an enlarged detail view similar to FIG. 6 of the linear motor drive portion showing the stator and armature thereof.
Figure 8:
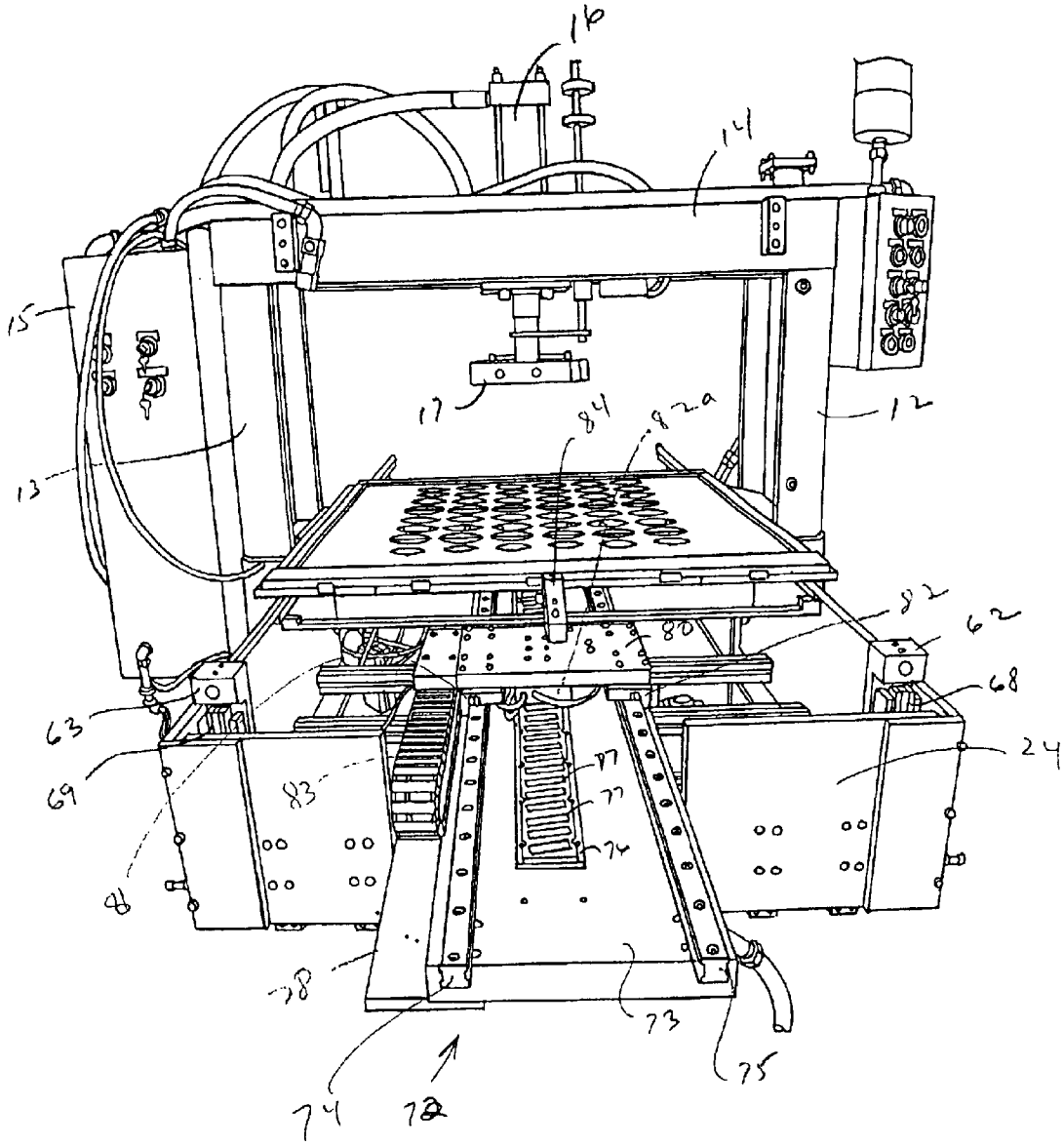
FIG. 8 is a rear elevational perspective view of the sheet moving platen and linear motor constructed in accordance with the present invention.

Referring to FIG. 6-8, the product feed mechanism, generally indicated at 20, is mounted on a box framework, generally indicated at 21, that is secured to the back of press bed 11. The box frame 21 includes a pair of elongate side members 22, 23 and a back panel 24 fastened, in this embodiment to the side members by vertical bracings 25, 26. Referring to FIGS. 1–3*b*, the product feed mechanism of the invention 20 includes a rectangular platen 30 upon which in the preferred use thereof, a molded plastic sheet will be precisely positioned and firmly retained. Rectangular platen 30 includes a plurality of apertures 30*a*—30*a* through which the dies may operate on the sheet thereon (not shown). The platen 30 rides along a pair of opposing feed bars 31, 32 into and through the area between the crown 14 and the press bed 11. Referring to FIGS. 3*a*, 3*b*, a robotic arm 33 affixed to the crown in this embodiment, is capable of moving sheet products onto and off of the platen 30 as desired.

Figure 4:
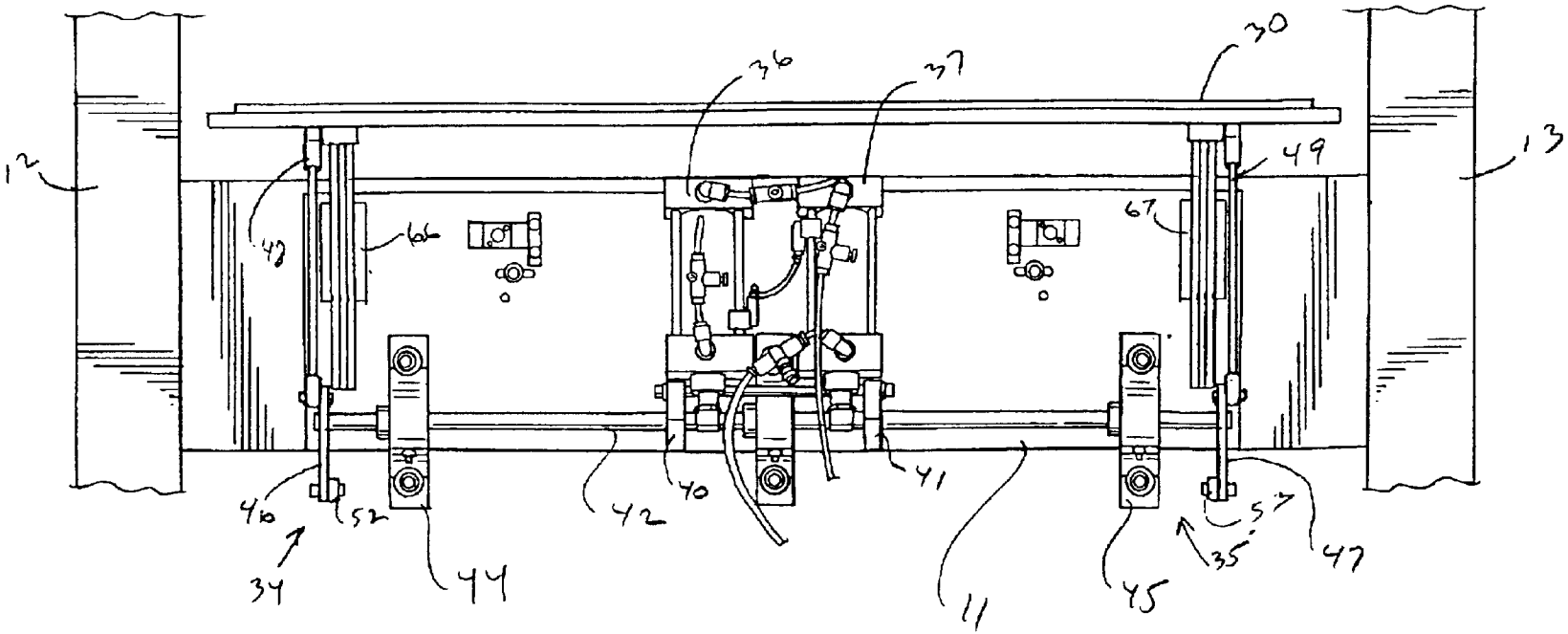
FIG. 4 is a fragmentary enlarged detail front elevational view of the platen moving linkage of the present invention.
Figure 5:
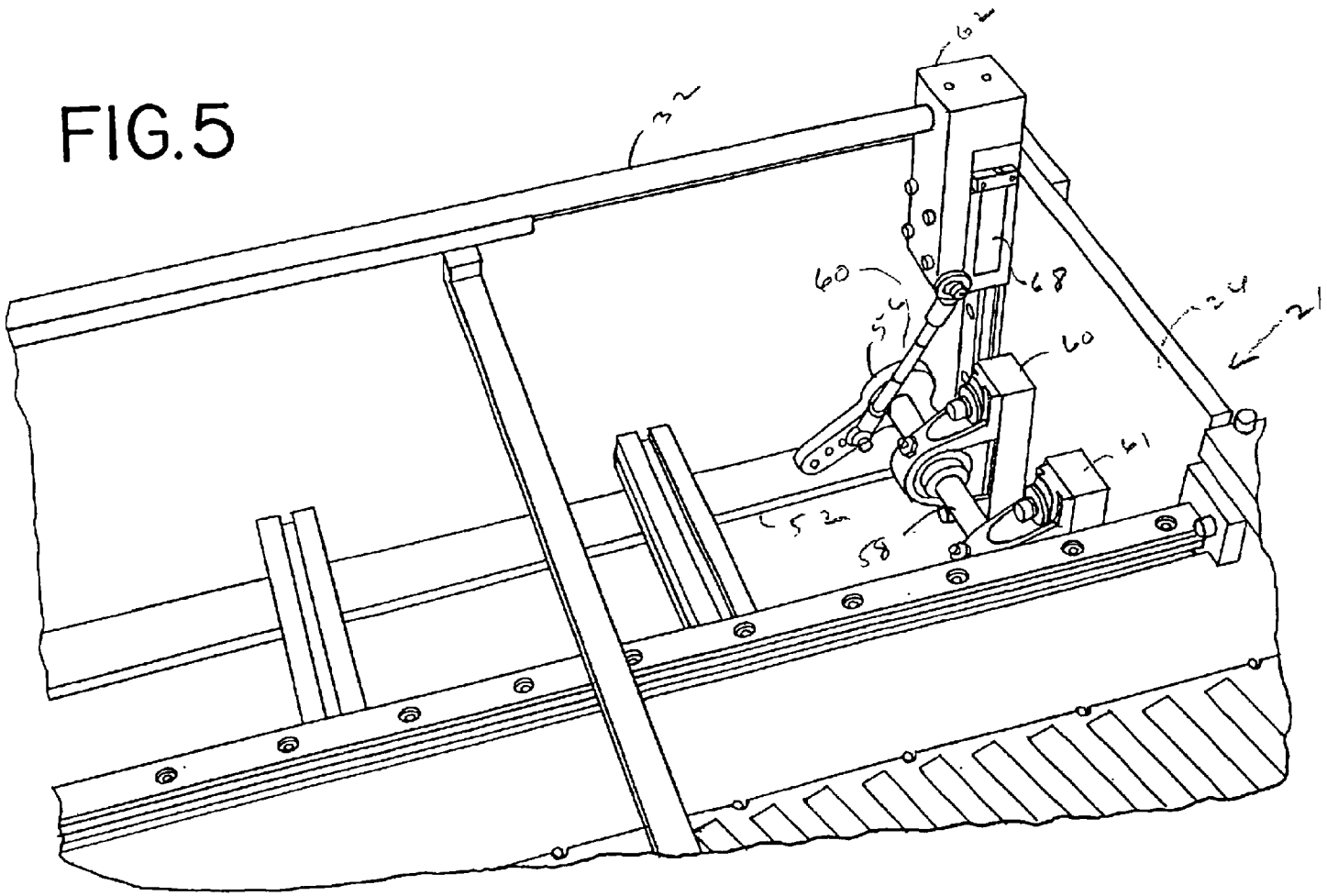
FIG. 5 is a fragmentary detailed perspective view showing the rear portion of one side of the platen lifting linkage.

Referring to FIGS. 1–4, the lifting mechanism that keeps the platen 30 in a horizontal position while the platen raises, moves toward the space between the crown 14 and the bed 11 and then lowers the platen toward the lower die (not shown) includes a pair of mirror image shaped multiple link mechanisms generally indicated at 34, 35 in FIGS. 1, 3*a*, 3*b* and 4 (35 is only shown in FIG. 4).

The front portion of the linking mechanisms 34, 35 shown in FIG. 4 include a pair of pneumatic cylinders 36, 37 which drive a single connecting rod 38 mounted at opposing ends to offset levers 40, 41 both positioned on a single drive shaft 42 that is bearingly retained by pillow blocks 44, 45 mounted on the front wall of the press bed 11. Adjacent each of the opposed ends of drive shaft 42 is mounted a bell crank 46, 47 respectively. At one pivotal position on bell crank 47, a link 48 extends upward to a block 50 on which feed bar 32 is mounted. At the same position on the opposing bell crank 47, a link 49 extends upwardly to block 51 and is pivotally mounted thereto. Block 51 is secured to feed bar 31. At the second pivotal mounting on bell crank 46, a horizontal link 52 extends backwardly to the rear of the box frame 21. At the second pivotal mounting of bell crank 47, an identical horizontal link 53 (FIG. 4) extends backwardly from the bell crank toward the rear of the box frame 21. At its rear, link 52 is pivotally mounted to a bell crank 56 positioned adjacent the end of a driven shaft 58 bearingly mounted in pillow blocks 60, 61, mounted securely to the back wall 24 of box frame 21.

In like manner, horizontal link 53 extends rearwardly to an opposing bell crank (not shown) mounted on the opposing end of driven shaft 58. On the opposing pivotal mounting of bell crank 56, a link 60 connects the bell crank to a mounting block 62 which is rigidly connected to the feed bar 32. Likewise, an identical link (not shown) mounted to the opposing pivot of the opposing bell crank mounted on the opposite end of driven shaft 58 connects that bell crank with block 64 (FIG. 6) that supports feed bar 31.

FIG. 3*a* shows the previously described identical linking mechanisms 34 (35-not shown) in the downward or lowered position and FIG. 3*b* shows the linking mechanisms 34 (35-not shown) as they appear in the upward or extended position. While the linking mechanisms drive the platen and feed bars upward and downward, in order to maintain the strict vertical movement of the feed bars 31, 32, and precisely maintain the horizontal position of the platen 30 thereon, each of the front mounting blocks 50, 51 are reciprocally slidingly retained in linear bearings 66, 67 mounted on the front of the press bed 11. Each of the rear mounting block 62, 63 are reciprocally slidingly retained in linear bearings 68, 69 mounted on the inside of back rail 24 of the product feed mechanism 20 of the box frame 21.

These vertically mounted linear bearings assure that the movement of the feed bars 31, 32 will be vertical and that the front and back of the platen 30 will be moved vertically the same amount during the travel of the linking mechanisms 34, 35. Thus, completely vertical movement of the lifting and lowering mechanism is assured by use of the linear bearings on the four corners of the lifting and lowering mechanism.

Referring to FIGS. 6–8, the remaining portion of the product feed mechanism 20 includes a linear motor operated horizontal positioning drive, generally indicated at 72. Linear motor drive 72 is mounted on a motor bed 73 that extends from the press bed 11 rearwardly past the upright back rail 24 of the box frame 20. Elongate motor bed 73 further includes left and right guide rails 74, 75, respectively, positioned parallel to the edges of motor bed 73 and extending the length thereof. An elongate stator magnet yoke 76 is positioned between and parallel to the rails 74 and 75 on the top surface of bed 73. Yoke 76 has a plurality of rectangular magnets 77—77 positioned in spatial relation along the length thereof. The magnets are positioned in adjacent north-south polar relation as is customary with linear motors. Outside of the left guide rail 74, an elongate shelf 78 is positioned to provide a receiving shelf for electrical wiring to be discussed in greater detail below.

An armature housing plate 80 includes left and right L-shape angle guide rails 81 and 82 depending therefrom and positioned to complementarily slidingly engage with the left and right guide rails 74, 75 respectively to prevent lateral movement of the armature relative to the yoke. A coil armature housing 82 depends centrally from the armature mounting plate 80 and includes armature coils positioned thereon which are located in spatial relation immediately above the stator yoke 76.

Extending between the armature mounting plate 80 and shelf 78 is a movable articulated electrical wiring cage 83 which houses wiring necessary to run the linear motor as the armature mounting plate 80 reciprocates back and forth along the guide rails 74, 75. Articulated wiring cage 83 is capable of moving like tractor treads while keeping the wires therein in captured operating order. A drive arm 84 extends upwardly from the top of armature mounting plate 80 and is secured to the back side of platen 30 to assure that the horizontal motion of the platen 30 will follow the movement of the linear armature mounting plate 80.

In operation, the combined coordinated controlling of the linear motor 72 and the left and right lifting and lowering linking mechanisms 34, 35 provide a product feed mechanism 20 that will position the platen 30 with respect to the press bed 11 and crown 14 to an accuracy of plus or minus a few microns, while maintaining the platen 30 and the sheet of material to be operated on (not shown) that is mounted or set onto the platen 30 in precise horizontal position with respect to the upper and lower dies (not shown) at all times during vertical movement of the platen 30 and the sheet (not shown) thereon. In prior press finishing machines that pivoted the back end of the product feed bars, the vertical movement of the front of the feed mechanism had to be greater than in the embodiment of the invention in order to clear the dies during the forward feed. With the front and rear of the platen being horizontal at all times, the vertical travel is lessened and the accuracy of the vertical movement is greater and more precisely controlled.

In addition, rather than operating the product feed mechanism by a numerical control apparatus, an open architectural personal computer (PC) is utilized and housed in control box 90 (FIGS. 3*a*, 3*b*). The PC control provides unlimited programmable movement of the product feed mechanism 20 within the mechanical limits of the linear motor and linkage so that multiple operations may be performed at the same location of the sheet mounted on the platen, or so that multiple operations may be performed at as many differing locations along the length of the sheet mounted on the platen, as necessary. Alternatively, a programmable logic control (PLC) type operating machine control may be utilized, with a preferred unit being made and sold by Allen Bradley Control Logics.

In one finishing operation utilizing the product feed mechanism of the invention three inputs are fed into the computer program. The first input is the forward distance from the start point to a first punch point which could be an inside diameter punch, an outside diameter punch or a slitting operation. A second input to the computer would be the distance between the rows of the product to be operated on. A third input would be the number of rows of product. Thereafter, the platen would be moved back to the starting position. As mentioned previously, the use of an open architectural program with a personal computer for a controller allows an infinite number of movements and distances of movements to be input to the press.

Thus, an extremely versatile and infinitely controllable product feed mechanism has been shown and described which is usable with a press to move product into and out of the press for operations on that product as required during the manufacture thereof. While one embodiment of the present invention has been shown and described, it will be understood by those skilled in the art that many changes and modifications may be made without departing from the true spirit and scope of the present invention. It is the intent of the appended claims to cover all such changes and modifications which fall within the true spirit and scope of the invention.

What is claimed:

1. In combination, a transfer device for moving material through a press for actuation of said press thereon, said press including a horizontal bed, a pair of uprights, one adjacent each end of said horizontal bed, a box frame extending from a back of said horizontal bed, said transfer device being mounted on said box frame and said horizontal bed including product retaining means including a tray having leading and trailing portions thereof for retaining said material thereon and guide means on which said tray is positioned for aiding in the movement of said tray perpendicularly to the orientation of said press, an improvement in said transfer device and press combination comprising:

means including opposed pairs of bell cranks and parallel links pivotably mounted on and between opposed pairs of said bell cranks for moving said tray vertically, said leading and trailing portions thereof moving equal vertical distances during the same time interval to maintain a predetermined angular orientation between the tray and the press during vertical movement of the tray, said opposed pairs of bell cranks mounted on said press include one bell crank positioned subjacent each end of said guide means, a plurality of links each pivotally mounted between a bell crank and one adjacent end of said guide means, a pneumatic drive mechanism mounted on said press and operatively connected to one of said links and bell cranks for moving said opposed pairs of bell cranks and linkage about a range of motion resulting in identical vertical movement of each of said ends of said transfer device, a first pair of linear bearings mounted on one of said box frame and said bed, a second pair of said linear bearings mounted adjacent a back end of said box frame, and said guide means being mounted on and between respective ones of said first and second pairs of linear bearings.

2. In combination a transfer device for moving material through a press for actuation of said press thereon, said press including, a bed, a pair of uprights outwardly adjacent and perpendicular to said bed, a box frame affixed on a back of said bed, said transfer device mounted on said box frame and said bed having product retaining means having leading and trailing portions thereof for retaining said material thereon and guide means upon which said product retaining means is positioned for aiding in the movement of said product retaining means perpendicularly to the orientation of said press, an improvement in said transfer device and press combination comprising:

means including a linear motor for moving said product retaining means horizontally with great precision along said guide means, a stator of said linear motor, mounted on said box frame perpendicularly to said bed, and a movable armature of said linear motor is positioned in superior relation to said stator and is affixed to said training portion of said product retaining means.

3. In combination a transfer device for moving material through a press for actuation of said press thereon, said transfer device including a product retention means having leading and trailing portions thereof for retaining said material thereon and guide means on which said product retention means is retained for aiding in the movement of said product retention means perpendicularly to the orientation of said press, an improvement in said transfer device and press combination comprising:

means including a parallelogram linkage and a linear motor for maintaining said product retention means in a predetermined orientation with said press while moving said product retention means vertically with respect to said press and horizontally along said guide means with great precision, said parallelogram linkage including, opposed pairs of bell cranks mounted on said press including one bell crank positioned subjacent each end of said guide means, a plurality of links each pivotally mounted between a bell crank and one end of said guide means, at least one long link pivotally mounted between respective ones of said opposed pairs of bell cranks, and a pneumatic drive mechanism mounted on said press and operatively connected to one of said links and bell cranks for moving said bell cranks and linkage about a range of motion resulting said bell vertical movement of each of said ends of said product retention means.

4. The combination transfer device and press as defined in claim 3 wherein a movable armature is positioned in superior relation to said stator and is affixed to said trailing portion of said product retention means.

* * * * *